US009747740B2

(12) United States Patent
Buttolo et al.

(10) Patent No.: US 9,747,740 B2
(45) Date of Patent: Aug. 29, 2017

(54) SIMULTANEOUS BUTTON PRESS SECURE KEYPAD CODE ENTRY

(71) Applicant: Ford Global Technologies, LLC, Dearborn, MI (US)

(72) Inventors: Pietro Buttolo, Dearborn Heights, MI (US); James Stewart Rankin, II, Novi, MI (US); Dipanjan Ghosh, Livonia, MI (US); Harry Lobo, Canton, MI (US); Kassandra Ritter, Ann Arbor, MI (US); Jessica Smith, Roseville, MI (US); Stuart C. Salter, White Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 195 days.

(21) Appl. No.: 14/635,772

(22) Filed: Mar. 2, 2015

(65) Prior Publication Data

US 2016/0260270 A1 Sep. 8, 2016

(51) Int. Cl.
*G07C 9/00* (2006.01)

(52) U.S. Cl.
CPC ..... *G07C 9/0069* (2013.01); *G07C 9/00142* (2013.01); *G07C 9/00174* (2013.01)

(58) Field of Classification Search
CPC ..... G07C 9/00142; G07C 9/00174; G07C 9/0069
See application file for complete search history.

(56) References Cited

U.S. PATENT DOCUMENTS

| | | | |
|---|---|---|---|
| 4,721,954 | A | 1/1988 | Mauch |
| 4,792,783 | A | 12/1988 | Burgess et al. |
| 4,962,302 | A | 10/1990 | Katsumi |
| 5,132,880 | A | 7/1992 | Kawamura |
| 5,143,437 | A | 9/1992 | Matsuno et al. |
| 5,543,591 | A | 8/1996 | Gillespie et al. |
| 5,648,656 | A | 7/1997 | Begemann et al. |
| 5,650,929 | A | 7/1997 | Potter et al. |
| 5,697,844 | A | 12/1997 | Von Kohorn |

(Continued)

FOREIGN PATENT DOCUMENTS

| | | | |
|---|---|---|---|
| CN | 102445954 | B | 3/2014 |
| CN | 103942963 | A | 7/2014 |

(Continued)

OTHER PUBLICATIONS

Rasin, "An In-Vehicle Human-Machine Interface Module," XML Journal, Jan. 3, 2003, (9 pages), retrieved from http://xml.sys-con.com/node/40547 on Dec. 13, 2014.

(Continued)

*Primary Examiner* — Sisay Yacob
(74) *Attorney, Agent, or Firm* — Franklin A. MacKenzie; Brooks Kushman P.C.

(57) ABSTRACT

A keypad having a plurality of switches identifies a numerical value according to user input to the plurality of switches. The numerical value may be computed as a total count of the plurality of switches that are swiped across in a consistent direction or may be computed as a total count of the plurality of switches that are simultaneously pressed. The keypad may further send the numerical value to a controller configured to facilitate access to vehicle unlock functionality.

18 Claims, 6 Drawing Sheets

(56) References Cited

U.S. PATENT DOCUMENTS 5,757,268 A 5/1998 Toffolo et al.
5,796,179 A 8/1998 Honaga
5,848,634 A 12/1998 Will et al.
5,850,174 A 12/1998 DiCroce et al.
6,028,537 A 2/2000 Suman et al.
6,377,860 B1 4/2002 Gray et al.
6,397,249 B1 5/2002 Cromer et al.
6,449,541 B1 9/2002 Goldberg et al.
6,473,038 B2 10/2002 Patwari et al.
6,536,928 B1 3/2003 Hein et al.
6,935,763 B2 8/2005 Mueller et al.
7,009,504 B1 3/2006 Banter et al.
7,015,791 B2 * 3/2006 Huntzicker ..... G07C 9/00182 340/12.5
7,015,896 B2 * 3/2006 Levy ..... G06F 3/0235 345/168
7,034,655 B2 4/2006 Magner et al.
7,342,325 B2 3/2008 Rhodes
7,502,620 B2 3/2009 Morgan et al.
7,595,718 B2 * 9/2009 Chen ..... B60R 25/24 340/426.1
7,672,757 B2 3/2010 Hong et al.
7,706,740 B2 4/2010 Collins et al.
7,778,651 B2 8/2010 Billhartz
7,800,483 B2 9/2010 Bucher
7,810,969 B2 10/2010 Blackmore et al.
7,973,773 B2 7/2011 Pryor
8,065,169 B1 11/2011 Oldham et al.
8,073,589 B2 12/2011 Rasin et al.
8,324,910 B2 12/2012 Lamborghini et al.
8,344,850 B2 1/2013 Girard, III et al.
8,408,766 B2 4/2013 Wilson et al.
8,417,258 B2 4/2013 Barnes, Jr.
8,421,589 B2 4/2013 Sultan et al.
8,447,598 B2 5/2013 Chutorash et al.
8,476,832 B2 7/2013 Prodin et al.
8,482,430 B2 7/2013 Szczerba
8,797,295 B2 8/2014 Bernstein et al.
8,823,517 B2 9/2014 Hadsall, Sr.
8,831,514 B2 9/2014 Tysowski
8,856,543 B2 10/2014 Geiger et al.
8,866,604 B2 10/2014 Rankin et al.
8,873,147 B1 * 10/2014 Rhodes ..... G02B 27/0172 359/630
8,873,841 B2 10/2014 Yang et al.
8,880,100 B2 11/2014 Dobyns
8,930,045 B2 1/2015 Oman et al.
8,947,202 B2 2/2015 Tucker et al.
9,053,516 B2 6/2015 Stempora
9,078,200 B2 7/2015 Wuergler et al.
9,350,809 B2 5/2016 Leppanen
9,417,691 B2 8/2016 Belimpasakis et al.
2002/0069002 A1 6/2002 Morehouse
2002/0070923 A1 * 6/2002 Levy ..... G06F 3/0235 345/169
2002/0087423 A1 7/2002 Carbrey Palango et al.
2002/0092019 A1 7/2002 Marcus
2002/0096572 A1 7/2002 Chene et al.
2002/0178385 A1 11/2002 Dent et al.
2002/0197976 A1 12/2002 Liu et al.
2003/0078709 A1 4/2003 Yester et al.
2003/0171863 A1 9/2003 Plumeier et al.
2004/0034455 A1 2/2004 Simonds et al.
2004/0076015 A1 4/2004 Aoki et al.
2004/0215532 A1 10/2004 Boman et al.
2005/0040933 A1 * 2/2005 Huntzicker ..... G07C 9/00182 340/5.64
2005/0099320 A1 5/2005 Nath et al.
2005/0136845 A1 6/2005 Masuoka et al.
2005/0185399 A1 8/2005 Beermann et al.
2005/0261807 A1 11/2005 Sorensen et al.
2005/0261815 A1 11/2005 Cowelchuk et al.
2005/0288837 A1 12/2005 Wiegand et al.
2006/0075934 A1 4/2006 Ram
2006/0089755 A1 4/2006 Ampunan et al.
2006/0155429 A1 7/2006 Boone et al.
2006/0155547 A1 7/2006 Browne et al.
2006/0205456 A1 9/2006 Bentz et al.
2006/0250217 A1 11/2006 Hamling et al.
2006/0258377 A1 11/2006 Economos et al.
2006/0271261 A1 11/2006 Flores et al.
2007/0021885 A1 1/2007 Soehren
2007/0140187 A1 6/2007 Rokusek et al.
2007/0198472 A1 8/2007 Simonds et al.
2007/0201389 A1 8/2007 Murayama
2007/0262140 A1 11/2007 Long, Sr.
2008/0140868 A1 6/2008 Kalayjian et al.
2008/0180231 A1 * 7/2008 Chen ..... B60R 25/24 340/426.14
2008/0261643 A1 10/2008 Bauer et al.
2008/0288406 A1 11/2008 Seguin et al.
2009/0253439 A1 10/2009 Gantner et al.
2010/0091394 A1 4/2010 DeWind et al.
2010/0176917 A1 7/2010 Bacarella
2010/0197359 A1 8/2010 Harris
2010/0216401 A1 8/2010 Kitahara
2010/0222939 A1 9/2010 Namburu et al.
2010/0225443 A1 9/2010 Bayram et al.
2010/0231958 A1 9/2010 Okigami
2010/0233957 A1 9/2010 Dobosz
2010/0280711 A1 11/2010 Chen et al.
2010/0315373 A1 12/2010 Steinhauser et al.
2011/0086668 A1 4/2011 Patel
2011/0137520 A1 6/2011 Rector et al.
2011/0187496 A1 8/2011 Denison et al.
2011/0199298 A1 8/2011 Bassompiere et al.
2011/0219080 A1 9/2011 McWithey et al.
2012/0006611 A1 1/2012 Wallace et al.
2012/0065815 A1 3/2012 Hess
2012/0096908 A1 4/2012 Fuse
2012/0109451 A1 5/2012 Tan
2012/0136802 A1 5/2012 McQuade et al.
2012/0214463 A1 8/2012 Smith et al.
2012/0214471 A1 8/2012 Tadayon et al.
2012/0229253 A1 9/2012 Kolar
2012/0244883 A1 9/2012 Tibbitts et al.
2012/0254809 A1 10/2012 Yang et al.
2012/0268235 A1 10/2012 Farhan et al.
2012/0268242 A1 10/2012 Tieman et al.
2013/0015951 A1 1/2013 Kuramochi et al.
2013/0079951 A1 3/2013 Brickman
2013/0099892 A1 4/2013 Tucker et al.
2013/0116012 A1 5/2013 Okayasu
2013/0218371 A1 8/2013 Simard et al.
2013/0259232 A1 10/2013 Petel
2013/0300608 A1 11/2013 Margalef et al.
2013/0329111 A1 12/2013 Desai et al.
2013/0335222 A1 12/2013 Comerford et al.
2014/0043152 A1 2/2014 Lippman et al.
2014/0068713 A1 3/2014 Nicholson et al.
2014/0139454 A1 5/2014 Mistry et al.
2014/0142783 A1 5/2014 Grimm et al.
2014/0163774 A1 6/2014 Demeniuk
2014/0164559 A1 6/2014 Demeniuk
2014/0200736 A1 7/2014 Silvester
2014/0212002 A1 7/2014 Curcio et al.
2014/0213287 A1 7/2014 MacDonald et al.
2014/0215120 A1 7/2014 Saylor et al.
2014/0226303 A1 8/2014 Pasdar
2014/0258727 A1 9/2014 Schmit et al.
2014/0277935 A1 9/2014 Daman et al.
2014/0309806 A1 10/2014 Ricci
2014/0321321 A1 10/2014 Knaappila
2014/0375477 A1 12/2014 Jain et al.
2014/0379175 A1 12/2014 Mittermeier
2014/0380442 A1 12/2014 Addepalli et al.
2015/0039877 A1 2/2015 Hall et al.
2015/0048927 A1 2/2015 Simmons
2015/0094088 A1 4/2015 Chen
2015/0116085 A1 4/2015 Juzswik
2015/0116100 A1 4/2015 Yang et al.
2015/0123762 A1 5/2015 Park et al.
2015/0147974 A1 5/2015 Tucker et al.

(56) References Cited

U.S. PATENT DOCUMENTS

| | | | |
|---|---|---|---|
| 2015/0148990 | A1 | 5/2015 | Patel |
| 2015/0149042 | A1 | 5/2015 | Cooper et al. |
| 2015/0154531 | A1 | 6/2015 | Skaaksrud |
| 2015/0172902 | A1 | 6/2015 | Kasslin et al. |
| 2015/0178034 | A1 | 6/2015 | Penilla et al. |
| 2015/0181014 | A1 | 6/2015 | Gerhardt et al. |
| 2015/0204965 | A1 | 7/2015 | Magarida et al. |
| 2015/0210287 | A1 | 7/2015 | Penilla et al. |
| 2015/0223151 | A1 | 8/2015 | Lei et al. |
| 2015/0261219 | A1 | 9/2015 | Cuddihy et al. |
| 2015/0261573 | A1 | 9/2015 | Rausch et al. |
| 2015/0278164 | A1 | 10/2015 | Kim et al. |
| 2015/0283914 | A1 | 10/2015 | Malone |
| 2015/0294518 | A1 | 10/2015 | Peplin et al. |
| 2015/0332530 | A1 | 11/2015 | Kishita |
| 2015/0352953 | A1 | 12/2015 | Koravadi |
| 2015/0382160 | A1 | 12/2015 | Slay, Jr. et al. |
| 2016/0039430 | A1 | 2/2016 | Ricci |
| 2016/0055699 | A1 | 2/2016 | Vincenti |
| 2016/0119782 | A1 | 4/2016 | Kim |
| 2016/0133072 | A1 | 5/2016 | Santavicca |
| 2016/0203661 | A1 | 7/2016 | Pudar et al. |
| 2016/0214572 | A1 | 7/2016 | Snider |
| 2016/0248905 | A1 | 8/2016 | Miller et al. |
| 2016/0332535 | A1 | 11/2016 | Bradley et al. |

FOREIGN PATENT DOCUMENTS

| | | | |
|---|---|---|---|
| JP | 2011131833 | A | 7/2011 |
| WO | 2013052043 | A1 | 4/2013 |

OTHER PUBLICATIONS

Services—Bluetooth Development Portal, last accessed May 30, 2015, https://developer.bluetooth.org/gatt/services/Pages/ServicesHome.aspx. (1 page).

Azad, "The Quick Guide to GUIDs," Better Explained—Math insights that click, last accessed May 24, 2015, http://betterexplained.com/articles (15 pages).

Goodwin, "Add-on module auto-unlocks your car when your phone is near," CNET, Car Tech, Nov. 19, 2013, http://www.cnet.com/news/add-on-module-auto-unlocks-your-car-when-your-phone-is-near (2 pages).

Hertz 24/7, "Book. Unlock. Go. You can reserve your vehicle anywhere, anytime—up to 10 days in advance," last accessed Jul. 28, 2015, https://www.hertz247.com/parkridge/en-us/About (3 pages).

Klosowski, "Unlock Your Car with a Bluetooth Powered Keyless Entry System," Lifehacker, Sep. 30, 2013, http://lifehacker.com/unlock-your-car-with-a-bluetooth-powered-keyless-entry-1427088798 (2 pages).

Toyota, Toyota Prius C Brochure, 2015, available at http://www.toyota.com/priusc/ebrochure.

Thomas, "2010 Toyota Prius Touch Tracer Display," Mar. 3, 2009, available at https://www.cars.com/articles/2009/03/2010-toyota-prius-touch-tracer-display/.

Gahran, "Vehicle owner's manuals—now on smartphones," CNN.com, Jan. 31, 2011, available at http://www.cnn.com/2011/TECH/mobile/01/31/car.manual.phone/.

Specification of the Bluetooth System, Version 4.2, "Master Table of Contents & Compliance Requirements," Dec. 2, 2014, https://www.bluetooth.or/en-us/specification/adopted-specifications. (2,772 pages).

Shahzada, Carleton University, "Touch Interaction for User Authentication." May 2014. (124 pages).

Napa Sae-Bae, et al., NYU Poly, May 5-10, 2012, "Biometric-Rich Gestures: A Novel Approach to Authentication on Multi-touch Devices." (10 pages).

General Motors Corporation; Pontiac GTO Owner's Manual; 2005; pp. 3-19 and 3-20; https://my.gm.com/content/dam/gmownercenter/gmna/dynamic/manuals/2006/pontiac/gto/2006_gto_owners.pdf.

Bargshady et al., Precise Tracking of Things via Hybrid 3-D Fingerprint Database and Kernel Method Particle Filter, 2016, IEEE, pp. 8963-8971.

Murugappan et al., Wireless EEG Signals based Neuromarketing System using Fast Fourier Transform (FFT), 2014, IEEE, pp. 25-30.

Katoh et al., A Method of Advertisement Selection in Multiple RFID-Tags Sensor Network for a Ubiquitous Wide-Area Advertising Service, 2008, IEEE, pp. 519-524.

* cited by examiner

SIMULTANEOUS BUTTON PRESS SECURE KEYPAD CODE ENTRY

TECHNICAL FIELD

Aspects of the disclosure generally relate to secure entry of codes into keypads, such as vehicle security keypads.

BACKGROUND

Keypads are generally positioned on the exterior of a vehicle and are used to lock and unlock the vehicle, among other features. The driver may unlock the door in response to successfully inputting a factory code on the keypad, which is a code including a sequence of numbers or other such characters. The driver may also use the factory code to program a new code, sometimes referred to as a personalized code, which may be easier to remember than the factory code and usable to unlock the vehicle with the keypad.

Such keypads allow the driver to unlock and lock the vehicle without the use of a key. Generally, the keypad is electrically coupled to an electronic controller. The controller controls a mechanism to unlock and lock the vehicle in response to the factory code inputted by the driver via the keypad. Other such keyless entry systems may include remote frequency based transmitters operably coupled to the electronic controller. The electronic controller is configured to unlock and lock the doors of the vehicle in response to receiving radio frequency (RF) encoded signals from the transmitters.

SUMMARY

In a first illustrative embodiment, a vehicle includes a keypad, having a plurality of switches configured to receive user input, configured to identify a numerical value according to user input to the plurality of switches, the numerical value computed as a total count of the plurality of switches that are simultaneously pressed by the user, and send the numerical value to a controller configured to facilitate access to vehicle unlock functionality.

In a second illustrative embodiment, a vehicle includes a keypad, having a plurality of switches configured to receive user input, configured to identify a numerical value according to user input to the plurality of switches, the numerical value computed as a total count of the plurality of switches that are swiped across in a consistent direction by the user, and send the numerical value to a controller configured to facilitate access to vehicle unlock functionality.

In a third illustrative embodiment, a computer-implemented method includes identifying, by a keypad having a plurality of switches, a numerical value according to user input to the plurality of switches, the numerical value computed as a total count of one of (i) the plurality of switches that are swiped across in a consistent direction and (ii) the plurality of switches that are simultaneously pressed; and sending the numerical value to a controller configured to facilitate access to vehicle unlock functionality.

DETAILED DESCRIPTION

Figure 1:
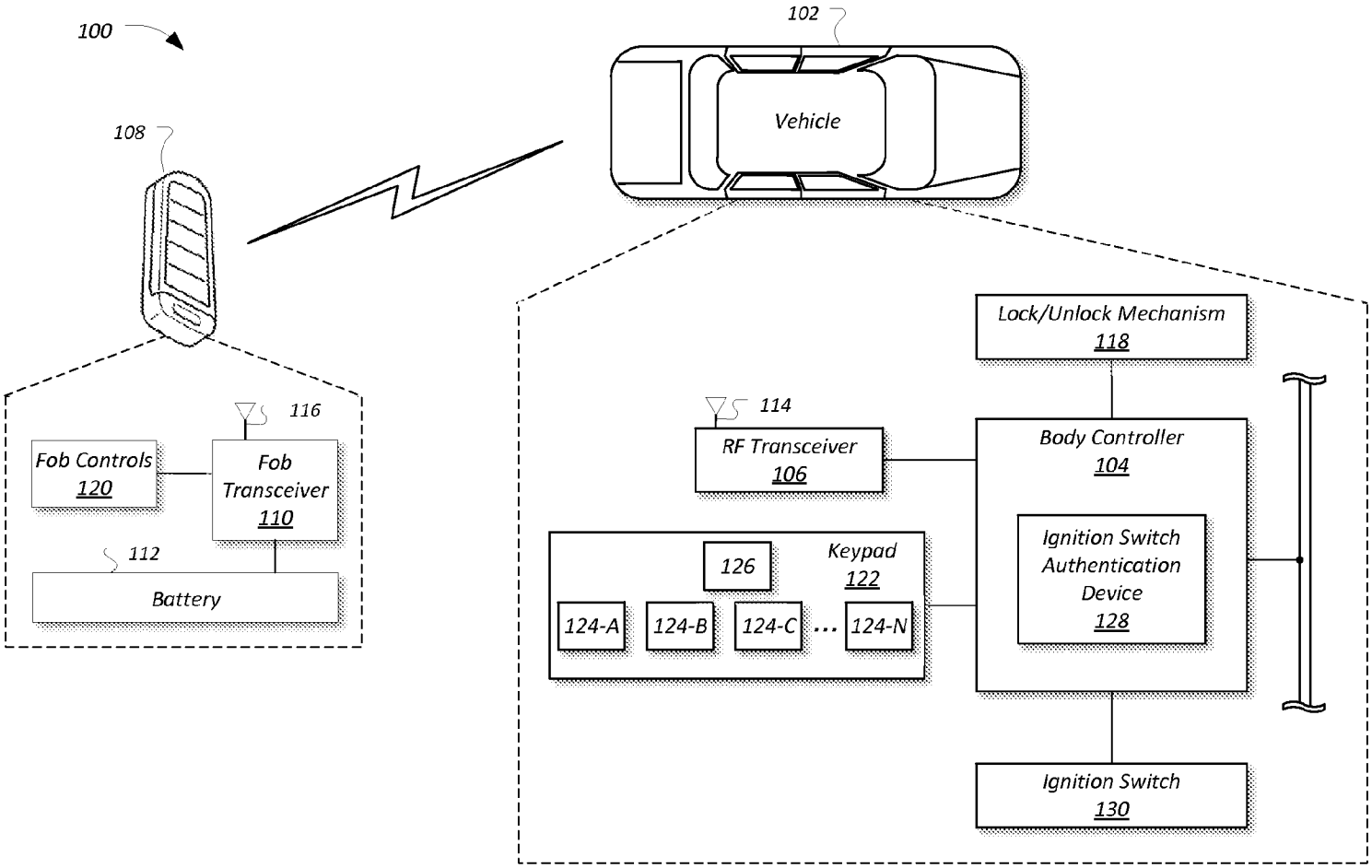
FIG. 1 illustrates an example keyless entry system for a vehicle having a keypad.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A vehicle system may include an external keypad, where individual sensors are used as buttons. Each sensor may correspond to a numeric character, an alpha character or a combination of alpha-numeric characters. Using the sensors of the keypad, a user may enter in a code. When a correct code is entered, the user may be able to unlock the vehicle. The system may further implement a timeout feature, in which the user may be required to enter the correct code within a specified time. In an example, the timeout may be controlled by the body control module (BCM) of the vehicle. The system may also implement a lockout feature which limits a number of incorrect code attempts by the user before locking out the keypad.

Keyless entry systems accordingly provide a convenient way for people to access a vehicle without the key fob or other authentication device. Such systems may be used by people who go jogging, working out, or on an excursion, and prefer to leave the key fob inside the vehicle. The systems can also be used to provide access to the interior of the vehicle to a friend or a child, without providing them with the ability to start the vehicle. While numerical keypads are intuitive and quick to use, traditional numerical keypad may place rigid constraints in exterior vehicle design, requiring the specific numerical graphical interface to be presented to the user. Additionally numerical keypads may suffer from security concerns whereby unauthorized users may utilize thermal imaging or other techniques to reconstruct access codes. For example, despite the lockout feature, an unauthorized user may be able to observe the user entering the code, and then use the code at a later time to gain access to the vehicle.

An improved keypad may implement multi-touch technology configured to recognize multiple finger contacts. In an example, the system may include a keypad having a plurality of individual capacitive pads or other switches. Other examples of improved keypads utilizing a single touchpad are described in detail in co-pending application Ser. No. 14/635,650, filed Mar. 2, 2015, the disclosure of which is hereby incorporated in its entirety by reference herein.

In an example, to enter a number, rather than pressing a button assigned to the number, the user may instead simultaneously press a number of the pads corresponding to the number. Thus, to enter to enter the number '2', the user simply touches any two pads simultaneously. When entering the numbers, in some implementations the keypad may optionally be configured to include a display configured to indicate the current number being entered. Using the improved keypad, if a code of a user is 35234, the user will place '3' fingers on the pad, then '5' fingers, then '2' fingers, then '3' fingers, and finally '4' fingers.

In another example, the numbers may be entered based on sliding gesture inputs across multiple pads or switches, rather than through simultaneous contact. The fundamental still remains the same that to enter '2' the user may touch two individual pads. However, instead of touching two pads simultaneously, the user may enter the '2' by sliding a finger across two pads. The direction of sliding can be in any available direction (e.g., right to left, left to right, top to bottom, bottom to top, etc.). Such a keypad may also optionally be configured to include a display configured to indicate the current number being entered.

Thus, as a code may be entered via the keypad using multiple touches or swipes across the keypad switches, it may be difficult for the unauthorized user to learn the user's code merely by watching. Moreover, as the keypad receives input according to how many buttons are presses or swiped across, numbers or other indications need not be placed on the keys of the keypad, improving keypad aesthetics. Yet further, as the resultant multiple touches or swipes may be used to generate numeric inputs, the multiple touch/swipe key codes may be backward compatible with existing numeric codes, and/or may allow for a keypad to accept numbers entered either as direct presses of the number, or according to the multiple touch/swipe techniques described herein.

FIG. 1 illustrates an example keyless entry system 100 for a vehicle 102 having a keypad 122. The system 100 may include a body controller 104 having a radio frequency (RF) transceiver 106. A key fob 108 may be in communication with the RF transceiver 106 of the controller 104 utilizing a fob transceiver 110 powered by a battery 112. An antenna 114 of the RF transceiver 106 may receive RF signals from an antenna 116 of the fob transceiver 110, and may deliver the signals to the RF transceiver 106. An unlock/lock mechanism 118 is operably coupled to the controller 104. The controller 104 is configured to control the unlock/lock mechanism 118 to unlock/lock doors of the vehicle 102 in response to the RF signals transmitted by the key fob 108. The key fob 108 may include one or more fob controls 120, such as a lock switch and an unlock switch. Accordingly, the controller 104 controls the unlock/lock mechanism 118 to lock the doors of the vehicle 102 in response to a user depressing a lock fob control 120 of the key fob 108, and to unlock the doors of the vehicle 102 in response to the user depressing an unlock fob control 120 of the key fob 108.

The keypad 122 is in electrical communication with the controller 104. The keypad 122 may be positioned on an exterior portion or section of the vehicle 102. In one example, the keypad 122 may be hardwired to the controller 104. In another example, the keypad 122 may be in RF communication with the controller 104 (e.g., via the RF antenna 114). The keypad 122 includes a plurality of mechanical pads, capacitive pads or other switches 124*a*-124*n* which correspond to numeric characters, alpha characters or any combination of alpha-numeric characters. The keypad 122 may further include a display 126 configured to display to the user the current character being entered into the keypad 122.

In an example, the keypad 122 may transmit commands via hardwired signals to the controller 104 which correspond to a sequence of numeric characters, alpha characters, or alpha-numeric characters in response to the user selecting various switches 124*a*-124*n*. In another example, the keypad 122 may transmit commands via RF signals which correspond to the alpha, numeric, or alpha-numeric characters to the controller 104 in response to the user selecting various switches 124*a*-124*n*. The controller 104 controls the unlock/lock mechanism 118 to unlock/lock the doors in response to receiving the commands, e.g., two or more signals (RF or hardwired) which correspond to a valid sequence of alpha, numeric, or alpha-numeric characters.

The key fob 108 may be implemented in connection with a base remote entry system, a passive entry passive start (PEPS) system or a passive anti-theft system (PATS). With the PEPS system, the controller 104 may control the unlock/lock mechanism 118 to unlock the door in response to the controller 104 determining that the key fob 108 is a predetermined distance away from the vehicle 102. In such a case, the key fob 108 automatically (or passively) transmits encrypted RF signals (e.g., without user intervention) in order for the controller 104 to decrypt (or decode) the RF signals and to determine if the key fob 108 is within the predetermined distance and are authorized. It is to be noted that with the PEPS implementation, the key fob 108 also generate RF signals which correspond to encoded lock/unlock signals in response to a user depressing a lock fob control 120 or an unlock fob control 120. In addition, with the PEPS system, a key may not be needed to start the vehicle 102. The user in this case may be required to depress the brake pedal switch or perform some predetermined operation prior to depressing a start switch after the user has entered into the vehicle 102. In the PATS implementation, the key fob 108 may operate as a conventional key fob in order to unlock/lock the vehicle 102. With the PATS implementation, a keys (not shown) is generally needed to start the vehicle 102. The key may include a RF transmitter embedded therein to authenticate the key to the vehicle 102.

The controller 104 includes an ignition switch authentication device 128. The ignition switch authentication device 128 may also include an RF receiver (not shown) and an antenna (not shown) for receiving RF signals transmitted by the RF transmitters of the keys. It should be noted that the ignition switch authentication device 128 may be implemented as a standalone controller (or module). The ignition switch authentication device 128 is configured to authenticate the particular type of mechanism used to start the vehicle 102. For example, with the PATS implementation, the key is inserted into an ignition switch 130 to start the vehicle 102. In such a case, the RF transmitter of the key transmits RF signals having encrypted data therein to the receiver of the ignition switch authentication device 128. The ignition switch authentication device 128 decrypts the data to authenticate the key prior to allowing the user to start the vehicle 102.

With the PEPS implementation, as noted above, a key is not needed to start the vehicle 102. In such a case, the ignition switch authentication device 128 authenticates the RF encrypted data passively transmitted by the transmitter 108*a*-108*n* to allow the user to start the engine of the vehicle 102. As noted above, in addition to the authentication device 128 authenticating the RF encrypted data, the user may perform a predetermined operation (e.g., pull handle of a door, or open door, toggle the brake pedal switch, or other operation) prior to depressing a start switch to start the vehicle 102. The system 100 contemplates a number of other operations from those listed prior to depressing the start switch to start the vehicle 102.

The keypad 122 may implement multi-touch technology configured to recognize multiple finger contacts. Rather than pressing a switch 124 of the keypad 122 assigned to a number or letter to input that character, the user may instead simultaneously press a number of the pads corresponding to the desired number. Thus, to enter a digit of an access code, such as a personal code or factory code, the user may simply simultaneously touch or swipe across a number of the pads representative of the digit of the code being entered. As a code may be entered via the keypad 122 using multiple touches or swipes across the keypad switches 124, it may be difficult for the unauthorized user to learn the user's code merely by watching. Moreover, as the keypad 122 may receive numerical input according to a number of button presses or number of pads swiped across, numbers or other indications need not be placed on or near the switches 124 of the keypad 122.

Figure 2A:
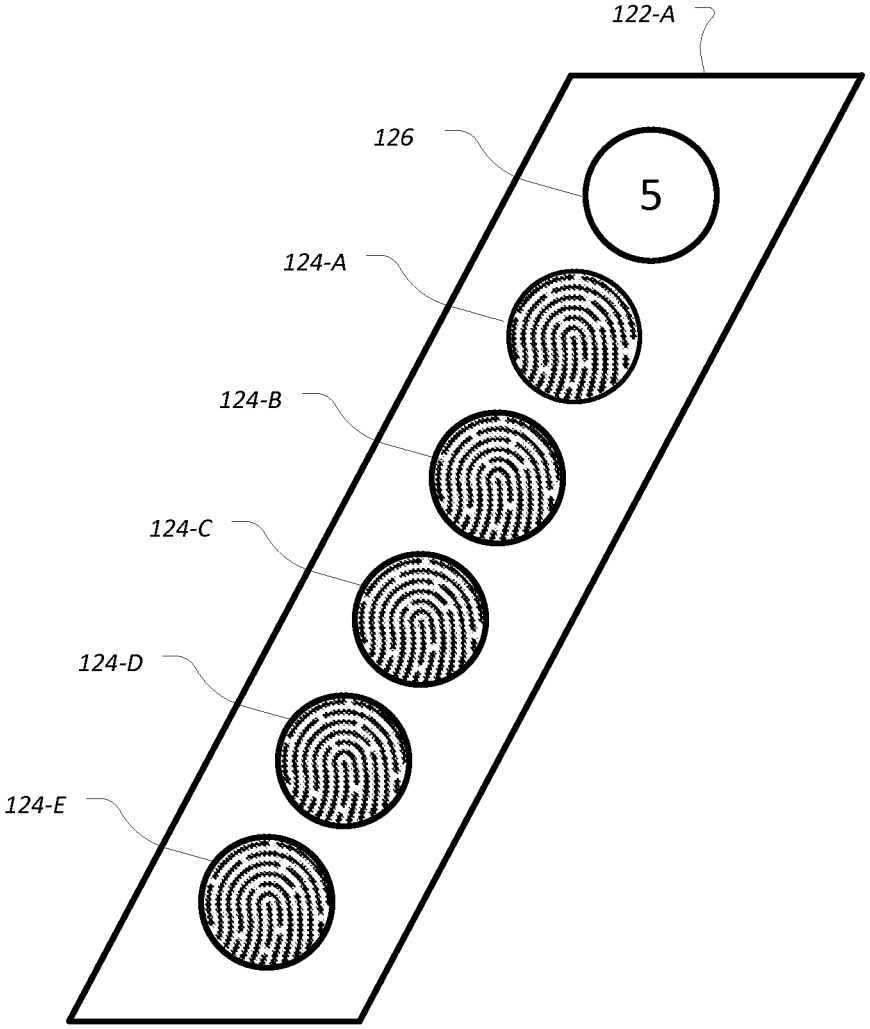
FIG. 2A illustrates an example of the keypad receiving multi-touch user input of a number.

FIG. 2A illustrates an example of a keypad 122-A receiving multi-touch user input of a number. As shown, the keypad 122-A includes five switches 124-A through 124-E and a display 126 element, all in a relatively upright orientation suitable for vertical use on a B-pillar or elsewhere on the outside of the vehicle 102. Also as shown, the user is pressing all five of the switches 124-A through 124-E, and the display 126 indicates a '5' to provide feedback of the entered number to the user. Variations on the design of the keypad 122-A are possible. For instance, keypads 122 may be implemented having a greater or fewer number of switches 124. Additionally or alternately, some keypads 122 may exclude the display 126, and/or may include switches 124 or displays 126 in different orientations or designs.

Figure 2B:
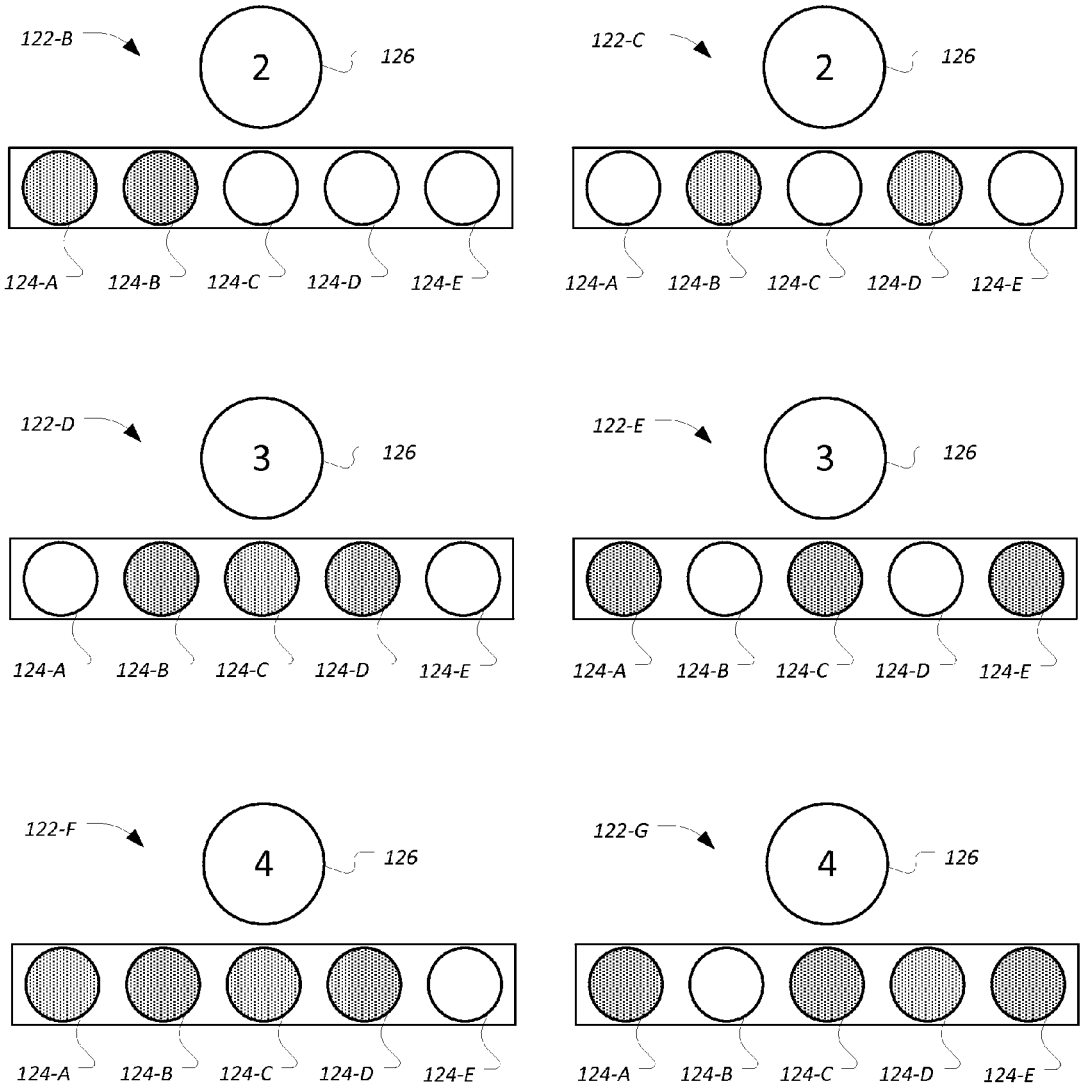
FIG. 2B illustrates further examples of the keypad receiving multi-touch user input of various numbers.

FIG. 2B illustrates examples of keypads 122 receiving multi-touch user input of various numbers. As shown, each of keypads 122-B and 122-C is receiving input from two of the switches 124 to designate the number '2', and includes an indication on the display 126 of the number '2'. It should be noted that these are only two of the possible ways to enter the number '2'. For a keypad of five switches 124 as illustrated in FIG. 2B, there may be ten different ways to enter the number '2'.

Each of keypads 122-D and 122-E is receiving input from three of the switches 124 to designate the number '3', and includes an indication on the display 126 of the number '3'. It should similarly be noted that these are only two of the ten possible ways to enter the number '3' using the multi touch keypad 122. Similarly, each of keypads 122-F and 122-G is receiving input from four of the switches 124 to designate the number '4', and includes an indication on the display 126 of the number '4'. It should again be noted that these are only two of the five possible ways to enter the number '4' using the multi touch keypad 122.

When the user releases the switches 124 of the keypad 122, the number may be considered to be entered by the keypad 122, and may be provided to the controller 104 for processing.

Figure 2C:
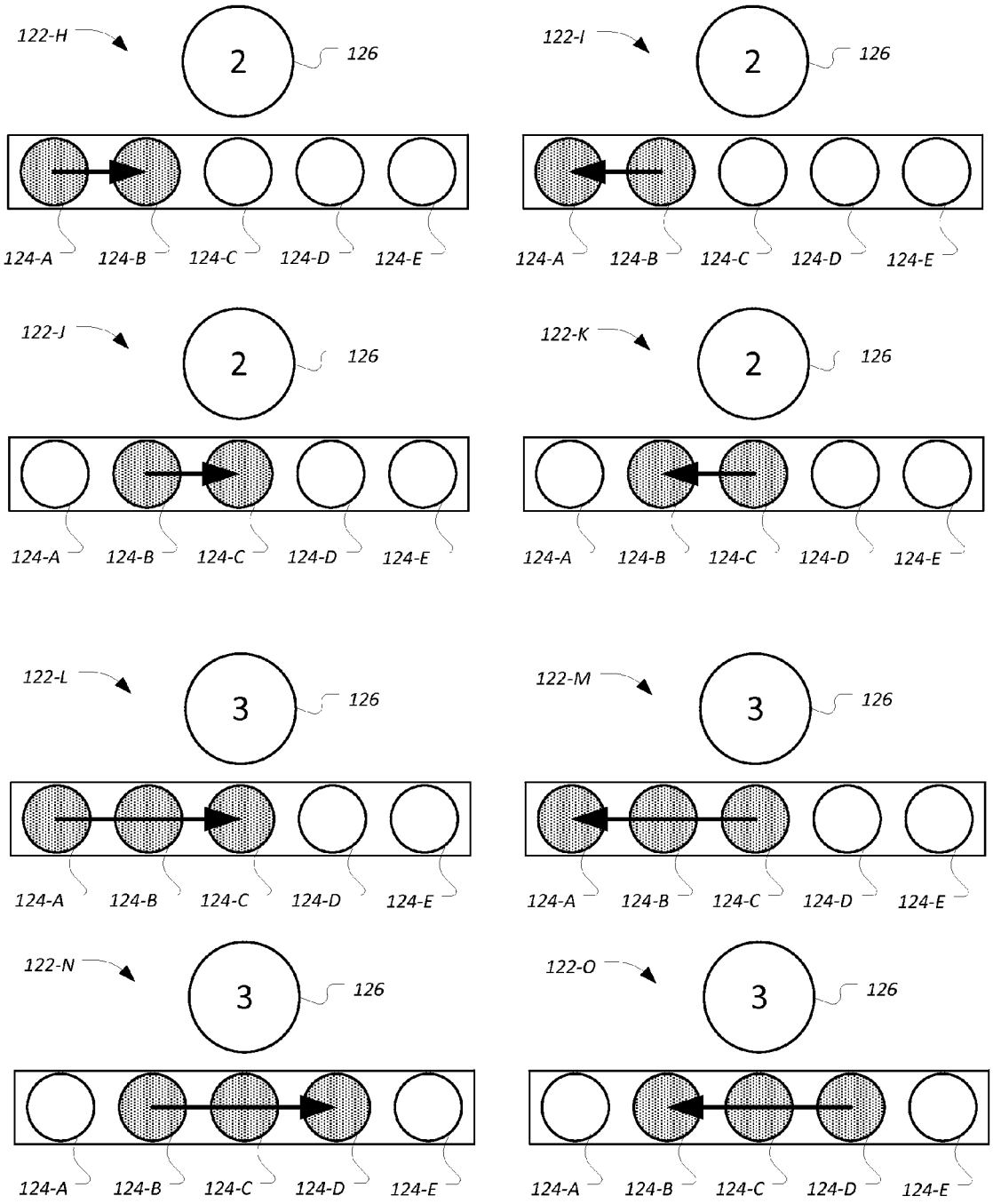
FIG. 2C illustrates examples of the keypad receiving swipe user input of various numbers.

FIG. 2C illustrates example keypads 122 receiving swipe user input of various numbers. As shown, each of keypads 122-H, 122-I, 122-J, and 122-K is receiving swipe input across two of the switches 124 to designate the number '2', and includes an indication on the display 126 of the number '2'. For instance, the keypad 122-H illustrates a swipe from switch 124-A to switch 124-B, the keypad 122-I illustrates a swipe from switch 124-B to switch 124-A, the keypad 122-J illustrates a swipe from switch 124-B to switch 124-C, and the keypad 122-K illustrates a swipe from switch 124-C to switch 124-D. It should be noted that these are only four of the possible ways to swipe the number '2'. For a keypad of five switches 124 as illustrated in FIG. 2C, there may be fourteen different ways to swipe the number '2'.

Similarly, each of keypads 122-L, 122-M, 122-N, and 122-O is receiving swipe input across three of the switches 124 to designate the number '3', and includes an indication on the display 126 of the number '3'. For instance, the keypad 122-L illustrates a swipe from switch 124-A over switch 124-B to switch 124-C, the keypad 122-M illustrates a swipe from switch 124-C over switch 124-B to switch 124-A, the keypad 122-N illustrates a swipe from switch 124-B over switch 124-C to switch 124-D, and the keypad 122-O illustrates a swipe from switch 124-D over switch 124-C to switch 124-B. It should be noted that these are only four of the possible ways to swipe the number '3'. For a keypad of five switches 124 as illustrated in FIG. 2C, there may be six different ways to swipe the number '3'.

Notably, the number illustrated by the display 126 may increment as the magnitude of the swipe increases. For instance, when the user presses a first switch 124, the display 126 may show the number '1'. When the user swipes to a second switch 124 adjacent to the first switch 124, the display 126 may increment to the number '2' to indicate the swiped value. When the user continues to swipe in the same direction to a third switch 124 adjacent to the second switch 124, the display 126 may increment to the number '3' to indicate the increased value that was swiped. When the user released from the keypad 122, the number may be considered to be entered by the keypad 122, and may be provided to the controller 104 for processing.

Figure 3:
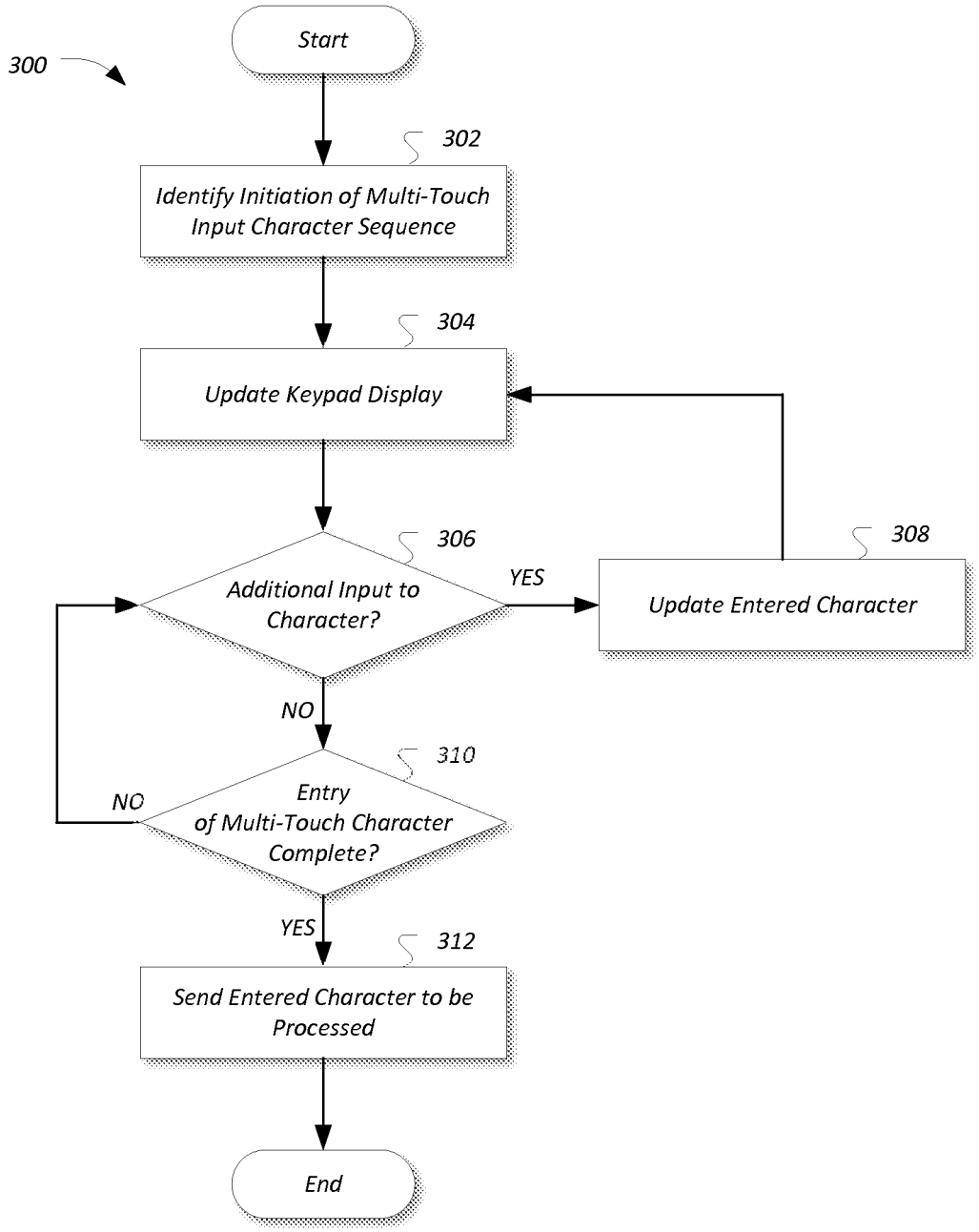
FIG. 3 illustrates an example process for receiving multi-touch or swipe user input using the keypad.

FIG. 3 illustrates an example process 300 for receiving multi-touch or swipe user input using the keypad 122. The process 300 may be performed, for example, by a keypad 122 such as one or more of the keypads 122-A through 122-O illustrated above with respect to FIGS. 2A-2C.

At operation 302, the keypad 122 identifies initiation of a multi-touch input character sequence. In an example, the keypad 122 may detect the initiation by a signal received from one or more of the switches 124 of the keypad 122 indicating that the user has pressed one or more of the switches 124.

At operation 304, the keypad 122 updates the keypad display 126. In examples where the keypad display 126 is present and enabled, the keypad 122 may update the keypad display 126 to indicate the value of the currently entered input character. For instance, when a multi-touch input character is initiated by a user pressed down on one of the switches 124, the keypad 122 may determine that the value is '1', and may direct the keypad display 126 to display the numeral '1'. In another example, when a multi-touch input character is initiated by a user pressed down on three of the switches 124, the keypad 122 may determine that the value is '3', and may direct the keypad display 126 to display the numeral '3'. In yet another example, responsive to the user pressing an additional one of the switches 124 or swiping across an additional one of the switches, the keypad 122 may determine that the input value is increased, and may direct the keypad display 126 to display the increased value.

At operation 306, the keypad 122 determines whether additional input was provided to the switches 124 that would require an update to the character being input. In an example, when entering a character using a swipe technique, such as shown in FIG. 2C, when the user swipes to a switch 124 adjacent to a previously swiped or pressed switch 124, the keypad 122 may determine that an increment may be required to the input value. In another example of a swipe scenario, when the user reverses direction and backs off from a previously swiped switch 124, the keypad 122 may determine that a decrement may be required to the input value. In an example of a multi-touch scenario, when the user additionally presses an additional switch 124 without releasing the currently pressed switch 124 or switches 124, the keypad 122 may determine that an increment may be required to the input value. In another example of a multi-touch scenario, when the user removes from pressing one of a plurality of switches 124 currently being pressed, the keypad 122 may determine that a decrement may be required to the input value. If additional input was provided to the switches 124 that requires an update to the character being input, control passes to operation 308. Otherwise, control passes to operation 310.

At operation 308, the keypad 122 updates the character being input. For instance, responsive to the user swiping to an additional switch 124, backing off from a previously swiped switch 124, pressing additional ones of the switches 124, or releasing from some of the currently pressed switches 124, the keypad 122 updates the character in accordance with the currently swiped or simultaneously pressed value. After operation 308, control returns to operation 304 to update the keypad display 126.

At operation 310, the keypad 122 determines whether entry of the multi-touch character is complete. In an example, when the keypad 122 determines that all of the switches 124 have been released, control passes to operation 312. In another example, when the keypad 122 detects that there has been no change to the entered value being input for a multi-touch timeout value (e.g., one second, two seconds, etc.), the keypad 122 considers the value to be complete and control passes to operation 312. Otherwise, control returns to operation 306 to determine whether additional input has been provided.

At operation 312, the keypad 122 sends the entered character to be processed. In an example, the keypad 122 may transmit the entered character to the controller 104 via a wired or wireless connection. After operation 312, the process 300 ends.

Figure 4:
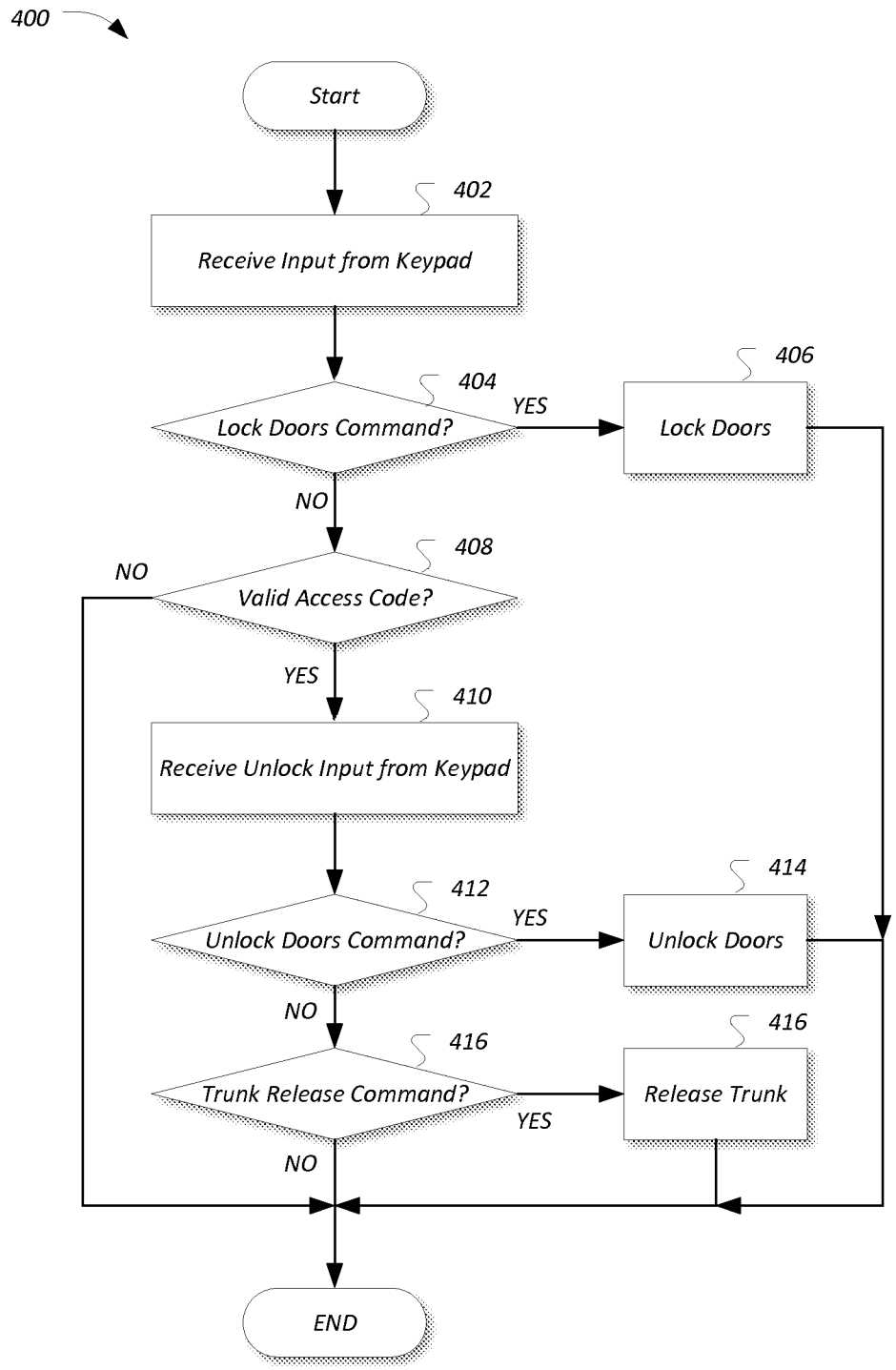
FIG. 4 illustrates an example process for utilizing a code input via a multi-touch keypad to access the vehicle.

FIG. 4 illustrates an example process 400 for utilizing a code input via a multi-touch keypad 122 to access the vehicle 102. The process 400 may be performed, in an example, by the controller 104 in communication with the keypad 122.

At operation 402, the controller 104 receives input from the keypad 122. In an example, the input may be entered into the multi-touch keypad 122 using the plurality of switches 124 of the keypad 122 according to the process 300.

At operation 404, the controller 104 determines whether a lock doors command was input to the keypad 122. In an example, the lock doors command may be specified by a user pressing and holding two of the switches 124 of the keypad 122, or swiping across two of the switches of the keypad 122 (or by entering another predefined value). As shown, the lock doors command may be entered without a user having to enter a personal code, but it should be noted that in other examples the personal code may be required for the lock command. If the lock doors command is input, control passes to operation 406.

At operation 406, the controller 104 locks the vehicle 102 doors. In an example, the controller 104 may command the unlock/lock mechanism 118 to lock the doors of the vehicle 102. After operation 406, the process 400 ends.

At operation 408, the controller 104 determines whether an access code was input to the keypad 122. In an example, the controller 104 may determine wither the input matches a previously set up personal code or a factory code included in the controller 104 as shipped. If an access code is entered, control passes to operation 410. Otherwise, the process 400 ends.

At operation 410, the controller 104 receives input from the keypad 122. In an example, once authenticated using the personal code, the user may enter an unlock command to be performed by the vehicle 102.

At operation 412, the controller 104 determines whether an unlock doors command was input to the keypad 122. In an example, the unlock doors command may be specified by a user pressing one of the switches 124 of the keypad 122 (or by entering another predefined value). If the unlock doors command was entered, control passes to operation 414. Otherwise, control passes to operation 416.

At operation 414, the controller 104 unlocks the vehicle 102 doors. In an example, the controller 104 may command the unlock/lock mechanism 118 to unlock the doors of the vehicle 102. After operation 414, the process 400 ends.

At operation 416, the controller 104 determines whether a trunk release command was input to the keypad 122. In an example, the trunk release command may be specified by a user pressing or swiping across two of the switches 124 of the keypad 122 (or by entering another predefined value). If the trunk release command was entered, control passes to operation 416. Otherwise, the process 400 ends.

At operation 418, the controller 104 releases the vehicle 102 trunk latch. In an example, the controller 104 may command the unlock/lock mechanism 118 to release the trunk latch of the vehicle 102. After operation 414, the process 400 ends.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle comprising:

a keypad, having a plurality of switches configured to receive user input, configured to identify a numerical value according to user input to the plurality of switches, the numerical value computed as a total count of a quantity of the plurality of switches that are simultaneously pressed by the user input; and send the numerical value to a controller configured to facilitate access to vehicle unlock functionality.

2. The vehicle of claim 1, further comprising the controller, configured to:

receive an access code from the keypad; and provide keypad access to the vehicle unlock functionality when the access code matches a code stored to the controller.

3. The vehicle of claim 1, wherein the keypad comprises a keypad display, and the keypad is further configured to send the numerical value to the keypad display to be displayed to the user.

4. The vehicle of claim 1, wherein the keypad is further configured to at least one of: (i) increase the numerical value responsive to receiving an additional press of one of the plurality of switches without releasing the plurality of switches that are simultaneously pressed by the user; and (ii) decrease the numerical value responsive to receiving a removal of a press of one of the plurality of switches without releasing all of the plurality of switches that are simultaneously pressed by the user.

5. The vehicle of claim 4, wherein the keypad comprises a keypad display, and the keypad is further configured to send the numerical value, as incremented or decremented, to the keypad display to update the user.

6. The vehicle of claim 1, wherein the plurality of switches includes five switches.

7. A vehicle comprising:

a keypad, having a plurality of switches configured to receive user input, configured to identify a numerical value according to user input to the plurality of switches, the numerical value computed as a total count of a quantity of the plurality of switches that are swiped across in a consistent direction by the user; and send the numerical value to a controller configured to facilitate access to vehicle unlock functionality.

8. The vehicle of claim 7, further comprising the controller, configured to:

receive an access code from the keypad; and provide keypad access to the vehicle unlock functionality when the access code matches a code stored to the controller.

9. The vehicle of claim 7, wherein the keypad comprises a keypad display, and the keypad is further configured to send the numerical value to the keypad display to be displayed to the user.

10. The vehicle of claim 7, wherein the keypad is further configured to at least one of: (i) increase the numerical value responsive to receiving an additional swipe press of one of the plurality of switches in the consistent direction; and (ii) decrease the numerical value responsive to receiving an additional swipe press of one of the plurality of switches in a direct opposite to the consistent direction.

11. The vehicle of claim 10, wherein the keypad comprises a keypad display, and the keypad is further configured to send the numerical value, as incremented or decremented, to the keypad display to update the user.

12. A method comprising:

identifying, by a keypad having a plurality of switches, a numerical value according to user input to the plurality of switches, the numerical value computed as a total count of one of (i) a quantity of the plurality of switches that are swiped across in a consistent direction or (ii) a quantity of the plurality of switches that are simultaneously pressed; and sending the numerical value to a controller configured to facilitate access to vehicle unlock functionality.

13. The method of claim 12, further comprising:

receiving, by a vehicle controller, an access code from the keypad; and providing keypad access to the vehicle unlock functionality when the access code matches a code stored to the controller.

14. The method of claim 12, further comprising sending the numerical value to a keypad display to be displayed to the user.

15. The method of claim 12, further comprising at least one of: (i) increasing the numerical value responsive to receiving an additional press of one of the plurality of switches without releasing the plurality of switches that are simultaneously pressed by the user; and (ii) decreasing the numerical value responsive to receiving a removal of a press of one of the plurality of switches without releasing all of the plurality of switches that are simultaneously pressed by the user.

16. The method of claim 15, further comprising sending the numerical value, as incremented or decremented, to a keypad display to update the user.

17. The method of claim 12, further comprising at least one of: (i) increasing the numerical value responsive to receiving an additional swipe press of one of the plurality of switches in the consistent direction; and (ii) decreasing the numerical value responsive to receiving an additional swipe press of one of the plurality of switches in a direct opposite to the consistent direction.

18. The method of claim 17, further comprising sending the numerical value, as incremented or decremented, to a keypad display to update the user.

* * * * *